US008009105B2

(12) United States Patent
Wang et al.

(10) Patent No.: US 8,009,105 B2
(45) Date of Patent: Aug. 30, 2011

(54) RFID ANTENNA AND ELECTRONIC PRODUCT HAVING THE RFID ANTENNA

(75) Inventors: Tun-Ping Wang, Tu-Cheng (TW); Tien-Chai Ni, Tu-Cheng (TW); Szu-Yung Wang, Tu-Cheng (TW); Ho-Hsin Chou, Tu-Cheng (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 389 days.

(21) Appl. No.: 12/413,517

(22) Filed: Mar. 28, 2009

(65) Prior Publication Data

US 2010/0245175 A1 Sep. 30, 2010

(51) Int. Cl.
*H01Q 1/38* (2006.01)

(52) U.S. Cl. ..... 343/700 MS; 343/795; 340/572.7

(58) Field of Classification Search ..... 343/700 MS, 343/795; 340/572.1, 572.7
See application file for complete search history.

(56) References Cited

U.S. PATENT DOCUMENTS

| | | | | |
|---|---|---|---|---|
| 7,215,295 | B2 * | 5/2007 | Egbert | 343/795 |
| 7,432,816 | B1 * | 10/2008 | Ku et al. | 340/572.7 |
| 7,546,671 | B2 * | 6/2009 | Finn | 29/592.1 |
| 7,748,638 | B2 * | 7/2010 | Hino et al. | 235/492 |
| 2009/0096696 | A1 * | 4/2009 | Joyce et al. | 343/793 |

* cited by examiner

*Primary Examiner* — Hoang V Nguyen

(57) ABSTRACT

A RFID antenna etched on a printed circuit board defined a first edge and a second edge includes a first antenna radiator, a second antenna radiator and a tag chip. The first antenna radiator located at the second edge has a first radiating portion. A first connecting portion bends outwards from an end of the first radiating portion. A second radiating portion extends from an end of the first connecting portion. A third radiating portion bends inwards from an end of the second radiating portion. The second antenna radiator has a fourth radiating portion extended along the first edge. A second connecting portion bends outwards and towards the first radiating portion from an end of the fourth radiating portion. A fifth radiating portion extends along the second edge from an end of the second connecting portion. The tag chip locates between the third radiating portion and the fifth radiating portion.

2 Claims, 1 Drawing Sheet

RFID ANTENNA AND ELECTRONIC PRODUCT HAVING THE RFID ANTENNA

BACKGROUND OF THE INVENTION

1. Field of the Invention

The invention relates to an antenna, and particularly to a RFID antenna and an electronic product having the RFID antenna.

2. The Related Art

Bluetooth is a technology applied in short range wireless communications between electronic devices, such as between PDA and laptop computer or between mobile phone and vending machine. The electronic devices provided with Bluetooth antenna inside are able to transmit wireless information with each other. But, more and more fake products come forth on the market. Though the appearance of the fake product is analogical to that of the real products, the quality and performance of the fake product is worse than that of the real product. Therefore, it is important for general purchasers to distinguish the real products from the counterfeits.

In view of the case mentioned above, Radio Frequency Identification (RFID) is provided for solving the problem. The RFID can identify a tag automatically and obtain correlative data via radio frequency signals. Conventionally, a RFID system includes the tag, a reader and a RFID antenna transmitting the radio frequency signals between the tag and the reader. The tag attached on the electronic product, which includes a coupling element and a CMOS chip, has a unique electronic coding. The information reserved in the CMOS chip of the electronic product is delivered to the reader via the RFID antenna. Hence, the purchasers can distinguish the authentic product and the fake product.

Nevertheless, the conventional RFID antenna mounted inside the product takes bigger space, which may interfere with other electronic components, such as a Bluetooth antenna. Furthermore, it makes the radiant intensity of the RFID antenna weaker. As a result, the reader needs to touch the tag for reading the information of the electrical product.

SUMMARY OF THE INVENTION

An object of the present invention is to provide a RFID antenna etched on a printed circuit board defined a first edge and a second edge. The RFID antenna includes a first antenna radiator, a second antenna radiator and a tag chip. The first antenna radiator located at the second edge has a first radiating portion of strip shape. A first connecting portion bends outwards from an end of the first radiating portion. A second radiating portion extends opposite to the first radiating portion from the other end of the first connecting portion. A third radiating portion bends inwards from the other end of the second radiating portion. The second antenna radiator has a fourth radiating portion extended along the first edge. A second connecting portion bends outwards and towards the first radiating portion from an end of the fourth radiating portion. A fifth radiating portion extends along the second edge from the other end of the second connecting portion. The tag chip locates between the third radiating portion and the fifth radiating portion.

Another object of the present invention is to provide an electronic product. The electronic product includes a printed circuit board with a first edge and a second edge, a RFID antenna etched on the printed circuit board and a Bluetooth antenna located at the different edge of the print circuit board from both the first edge and the second edge, and located away from the RFID antenna. The RFID antenna includes a first antenna radiator disposed at the second edge of the printed circuit board, a second antenna radiator and a tag chip. The first antenna radiator includes a first radiating portion of strip shape, a first connecting portion bent outwards from an end of the first radiating portion facing the first edge, a second radiating portion of strip shape extended opposite to the first radiating portion from the other end of the first connecting portion, and a third radiating portion bent inwards from the other end of the second radiating portion. The second antenna radiator includes a fourth radiating portion of strip shape extending along the first edge of the printed circuit board, a second connecting portion bent towards the second edge from an end of the fourth radiating portion adjacent to the second edge, and a fifth radiating portion of strip shape extending in alignment with the first radiating portion from the other end of the second connecting portion and spaced away from the third radiating portion. The tag chip is disposed between the third radiating portion and the fifth radiating portion.

As described above, the RFID antenna etched on the edges of the printed circuit board has a simple structure, which is efficient to save an internal space of the electronic product. The RFID antenna maintains a strong enough radiant intensity, so the reader can read the information in the tag without touching the tag. Furthermore, when the RFID antenna is disposed together with a Bluetooth antenna, a far distance is defined therebetween so as to avoid interfering with each other.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENT

Figure 1:
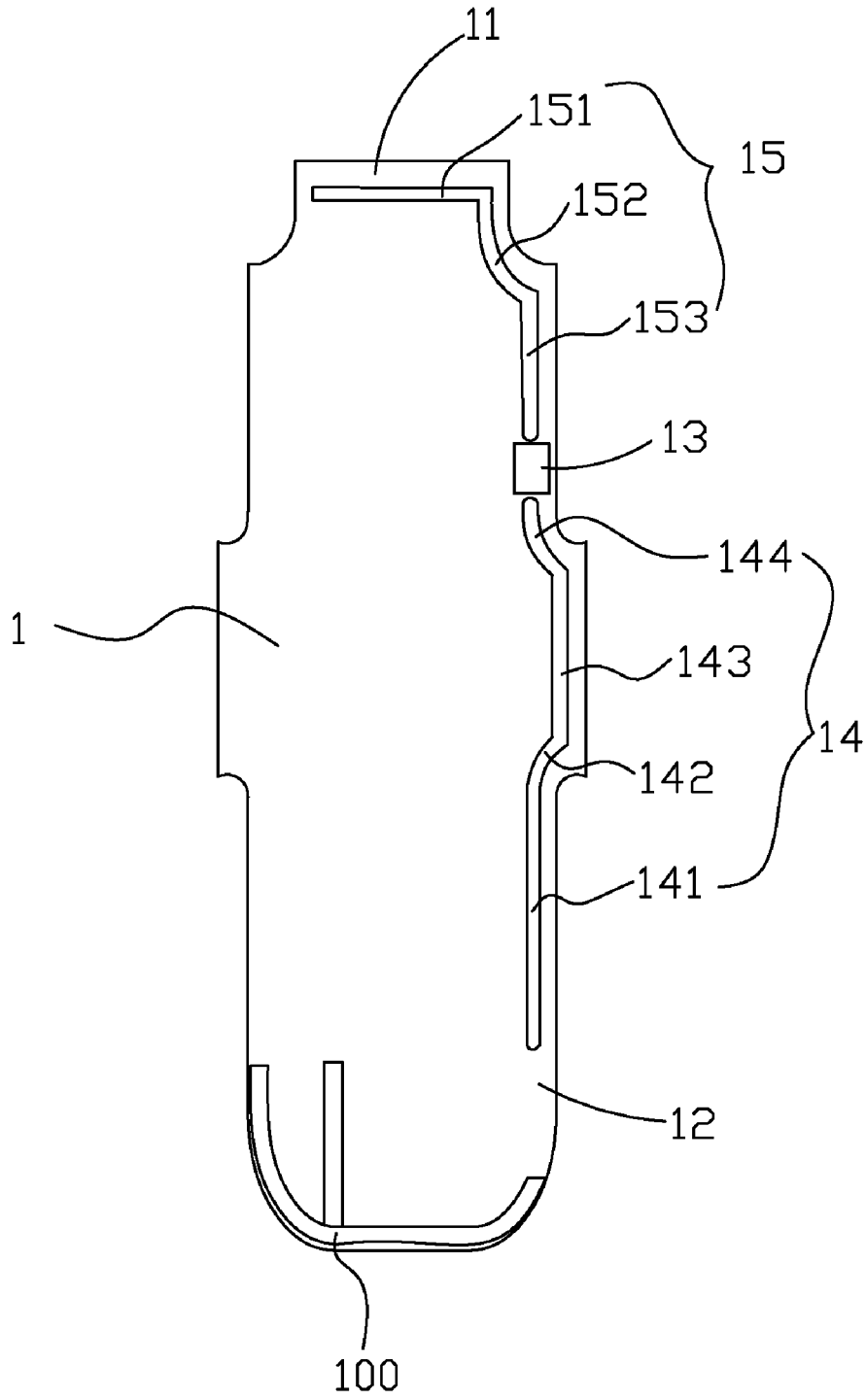
FIG. 1 is a plan view illustrating a structure of a RFID antenna according to an embodiment of the present invention.

Thereinafter, it takes a RFID antenna applied in a Bluetooth earphone as an example to describe.

Please refer to FIG. 1, the RFID antenna of an embodiment according to the present invention is shown. The RFID antenna may be etched on a printed circuit board (PCB) 1 made of brass foil. The PCB 1 of rectangular shape has a middle portion left for disposing electronic components (not shown) and defines a first edge 11 and a second edge 12 adjacent to the first edge 11. A Bluetooth antenna 100 is disposed at the different edge of the PCB 1 from both the first edge 11 and the second edge 12.

The RFID antenna includes a tag chip 13 of rectangle shape disposed at a portion of the second edge 12 adjacent to the first edge 11, a first antenna radiator 14 located at a side of the tag chip 13 opposite to the first edge 11 and a second antenna radiator 15 located at an opposite side of the tag chip 13. The first antenna radiator 14 extends along the second edge 12 and has a first radiating portion 141 of strip shape. The first radiating portion 141 extends an end facing the tag chip 13 bent outwards to form a first connecting portion 142. The first connecting portion 142 is arc shape. A second radiating portion 143 extends opposite to the first radiating portion 141 from the other end of the first connecting portion 142. The second radiating portion 143 is also a strip shape and parallel to the first radiating portion 141. The other end of the second radiating portion 143 bends inwards and extends towards the tag chip 13 to form a third radiating portion 144 similar to the first connecting portion 142. In this embodiment, both of the first connecting portion 142 and the third radiating portion 144 have the same central angles, 73 degrees. A straight-line distance between two ends of the first connecting portion 142 is 2.51 millimeters. The first radiating portion 141 and the second radiating portion 143 are all 1 millimeter in width, and 9.80 millimeters and 7.13 millimeters in length, respectively.

The second antenna radiator 15 has a fourth radiating portion 151 disposed at the first edge 11 of the PCB 1. The fourth radiating portion 151 is a strip shape. An end of the fourth radiating portion 151 adjacent to the second edge 12 is bent inwards and extended towards the second edge 12 to form a second connecting portion 152 of arc shape. The other end of the second connecting portion 152 extends towards the tag chip 13 to form a fifth radiating portion 153 of strip shape disposed in alignment with the first radiating portion 141. In this embodiment, a central angle of the second connecting portion 152 is 82 degrees, and a straight-line distance between two ends of the second connecting portion 152 is 4.78 millimeters. The fourth radiating portion 151 and the fifth radiating portion 153 are 1 millimeter in width, and 10.30 millimeters and 5.95 millimeters in length, respectively.

As described above, the RFID antenna is disposed at the two edges of the PCB 1 away from the Bluetooth antenna 100, which not only reduces the occupied space, but also prevents interfering with each other. Furthermore, since the RFID antenna maintains a strong enough radiant intensity, the reader can read the information in the tag without touching the tag.

The RFID antenna of the present invention is not limited to be used in the Bluetooth earphone. Meanwhile, it can even be applied in other electronic products and achieve the same function.

Furthermore, the present invention is not limited to the embodiment described above; various additions, alterations and the like may be made within the scope of the present invention by a person skilled in the art. For example, respective embodiments may be appropriately combined.

What is claimed is:

1. A RFID antenna etched on a printed circuit board with a first edge and a second edge adjacent to the first edge defined thereon, comprising:

a first antenna radiator disposed at the second edge of the printed circuit board, the first antenna radiator including a first radiating portion of strip shape, a first connecting portion bent outwards from an end of the first radiating portion facing the first edge, a second radiating portion of strip shape parallel to the first radiating portion and extended opposite to the first radiating portion from the other end of the first connecting portion, and a third radiating portion bent inwards from the other end of the second radiating portion;

a second antenna radiator, the second antenna radiator including a fourth radiating portion of strip shape extending along the first edge of the printed circuit board, a second connecting portion bent towards the second edge from an end of the fourth radiating portion adjacent to the second edge, and a fifth radiating portion of strip shape extending in alignment with the first radiating portion from the other end of the second connecting portion and spaced away from the third radiating portion; and a tag chip disposed between the third radiating portion and the fifth radiating portion.

2. An electronic product, comprising:

a printed circuit board with a first edge and a second edge defined thereon;

a RFID antenna etched on the printed circuit board, the RFID antenna comprising a first antenna radiator disposed at the second edge of the printed circuit board, the first antenna radiator including a first radiating portion of strip shape, a first connecting portion bent outwards from an end of the first radiating portion facing the first edge, a second radiating portion of strip shape parallel to the first radiating portion and extended opposite to the first radiating portion from the other end of the first connecting portion, and a third radiating portion bent inwards from the other end of the second radiating portion, a second antenna radiator, the second antenna radiator including a fourth radiating portion of strip shape extending along the first edge of the printed circuit board, a second connecting portion bent towards the second edge from an end of the fourth radiating portion adjacent to the second edge, and a fifth radiating portion of strip shape extending in alignment with the first radiating portion from the other end of the second connecting portion and spaced away from the third radiating portion, and a tag chip disposed between the third radiating portion and the fifth radiating portion; and a Bluetooth antenna, the Bluetooth antenna located at the different edge of the print circuit board from both the first edge and the second edge, and located away from the RFID antenna.

* * * * *